US007117920B2

(12) United States Patent
Dekker et al.

(10) Patent No.: US 7,117,920 B2
(45) Date of Patent: Oct. 10, 2006

(54) AUTOMATICALLY ACTIVATED CORD LOCK

(75) Inventors: Nicolaas Dekker, Barendrecht (NL); Hien Kieu, Sprang Capelle (NL)

(73) Assignee: Hunter Douglas Industries BV, El Rotterdam (NL)

( * ) Notice: Subject to any disclaimer, the term of this patent is extended or adjusted under 35 U.S.C. 154(b) by 100 days.

(21) Appl. No.: 10/932,808

(22) Filed: Sep. 2, 2004

(65) Prior Publication Data

US 2005/0056384 A1 Mar. 17, 2005

(30) Foreign Application Priority Data

Sep. 2, 2003 (EP) ..... 03077752
Jul. 9, 2004 (EP) ..... 04076988

(51) Int. Cl.
*E06B 9/324* (2006.01)

(52) U.S. Cl. ..... 160/178.2; 160/84.04

(58) Field of Classification Search ..... 160/178.2, 160/168.1 R, 173 R, 84.04, 178.1 R; 24/134 R, 24/134 L, 136 R
See application file for complete search history.

(56) References Cited

U.S. PATENT DOCUMENTS 2,010,286 A * 8/1935 Wiener et al. ..... 24/134 KB
2,057,608 A * 10/1936 Carroll ..... 24/134 KB
2,175,977 A * 10/1939 Stuber et al. ..... 160/168.1 R
3,040,403 A * 6/1962 Gunter et al. ..... 24/134 KB
3,221,802 A * 12/1965 Cornelis ..... 160/173 R
3,455,365 A * 7/1969 Stall ..... 160/344
3,633,646 A * 1/1972 Zilver ..... 160/168.1 R
4,646,808 A * 3/1987 Anderson ..... 160/178.2
4,660,612 A * 4/1987 Anderson ..... 160/173 R
5,143,135 A * 9/1992 Kuhar ..... 160/107
5,156,196 A * 10/1992 Corey et al. ..... 160/178.2
5,472,036 A * 12/1995 Judkins ..... 160/178.2

FOREIGN PATENT DOCUMENTS

EP 0 690 199 A1 1/1996

* cited by examiner

*Primary Examiner*—David Purol
(74) *Attorney, Agent, or Firm*—Dorsey & Whitney LLP

(57) ABSTRACT

A cord lock for use in a window covering for selectively locking lift cords in a predetermined position includes a housing adapted to be fitted in the head rail of the window covering with the housing having a pivotal locking lever with a cord gripping formation at one end adjacent a locking surface on the housing and a cord guiding passage at the opposite end through which the lift cords can pass. The locking lever is pivoted about a pivot pin that is located between the cord gripping formation and the cord guiding passage so that the cord gripping formation can move toward and away from engagement with the locking surface with pivoting movement of the locking lever about the pivot pin. A fixed guiding surface is also provided around which the lift cords pass for dependable operation of the cord lock.

20 Claims, 12 Drawing Sheets

AUTOMATICALLY ACTIVATED CORD LOCK

CROSS REFERENCE TO RELATED APPLICATIONS

This application claims priority to European patent application No. 03077752, filed Sep. 2, 2003, and European patent application No. 04076988, filed Jul. 9, 2004, which are hereby incorporated by reference as if fully disclosed herein.

BACKGROUND OF THE INVENTION

1. Field of the Invention

The invention relates to an automatically activated cord lock for one or more lift cords of a window covering, particularly for pleated blinds.

2. Description of the Relevant Art

Such a cord lock, which locks automatically when its lift cord is not being pulled downwardly to raise a window covering, is known from EP 0 690 199 B1. Although this cord lock has generally been satisfactory in normal use, the necessity for mounting it in a slanted head rail of a window covering has sometimes interfered with its operation.

SUMMARY OF THE INVENTION

In order to overcome this problem and provide an automatically activated cord lock, especially for a window covering, particularly a pleated blind, which is easier to assemble and operate and which is less expensive, this invention provides a cord lock that includes:

- a housing adapted to be fitted to a longitudinally-extending head rail of a window covering, the housing having parallel first and second walls and a locking surface extending between the first and second walls;
- a locking lever, within the housing, having a cord-gripping formation on one end, adjacent the locking surface, and a cord-guiding passage at an opposite end, remote from the locking surface; the locking lever being pivoted about a pivot pin that is located between the cord-gripping formation and the cord-guiding passage and extends between the first and second walls of the housing, so that the cord-gripping formation can move towards and away from engagement with the locking surface with pivoting movement of the locking lever about the pivot pin; and
- a fixed guiding surface located between the ends of the locking lever.

It is advantageous that the first and second walls and the locking lever extend horizontally, the cord-guiding passage extends laterally, and the pivot pin and the guiding surface extend vertically. It is especially advantageous that the pivot pin be located laterally between the guiding surface and the locking surface. It is particularly advantageous that an upper portion of any lift cord of the window covering extend slidably upwardly to the cord-guiding passage and then horizontally and laterally through the cord-guiding passage, then horizontally and laterally about the guiding surface, then horizontally and longitudinally about the cord-gripping formation and then horizontally and longitudinally between the cord-gripping formation and the locking surface. It is quite particularly advantageous that the guiding surface also extends between the first and second walls of the housing.

BRIEF DESCRIPTION OF THE DRAWINGS

Further aspects of the invention will be apparent from the detailed description below of particular embodiments and the drawings thereof, in which:

in FIG. 6, the cord lock is in its unlocked position, not gripping a lift cord, and in FIG. 7, the cord lock is in its locked position, gripping a lift cord;

in FIG. 18, the cord lock is in its locked position, and in FIG. 19, the cord lock is in its unlocked position.

DETAILED DESCRIPTION OF THE PREFERRED EMBODIMENTS

Figure 1:
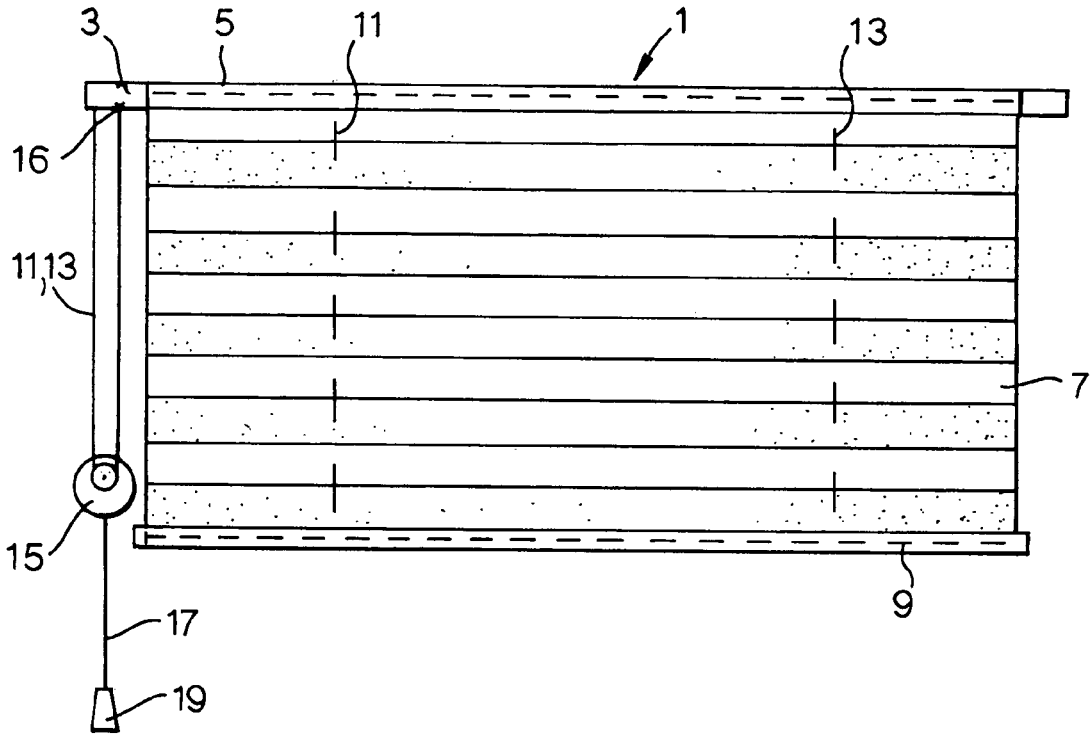
FIG. 1 is a schematic plan view of the front of a pleated blind with a cord lock attached to its head rail.

FIG. 1 shows a conventional pleated blind 1 with a cord lock 3 as a longitudinal extension on the left side of its longitudinally-extending head rail 5. A longitudinally-extending bottom rail 9 of the blind 1 can be raised and lowered to retract or to deploy a pleated blind fabric 7 by means of conventional lift cords 11, 13 (shown as a single line in FIG. 1). Each lift cord 11, 13 is attached, at one end, to the bottom rail 9 and extends upwardly through the head rail 5 and then through the cord lock 3. The lift cords 11, 13 extend downwardly from the cord lock 3, are looped through a conventional cord connector 15 and then extend upwardly toward the cord lock. The free ends of the lift cords are then attached to a fixed cord end receptor 16 on the cord lock. The cord connector 15 can be pulled by means of a single manipulating cord 17, depending from the cord connector, or by means of a tassel 19, depending from the manipulating cord 17, to raise the bottom rail 9 by a distance that is twice the pulling stroke on the manipulating cord 17. This arrangement is particularly suitable for a large pleated blind 1 and prevents excessive lengths of lift cords 11, 13 dangling downwardly when the blind is raised. In this regard, excess lengths of lift cords can present a safety hazard for small children.

Figure 2:
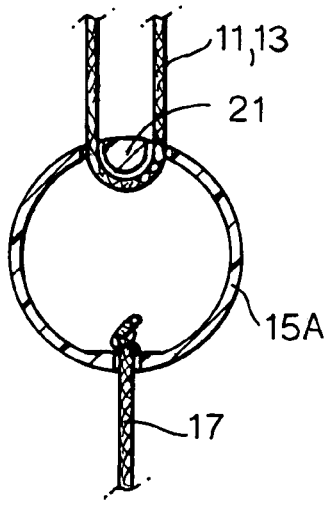
FIGS. 2 and 3 are schematic vertical-sectional views of conventional cord connectors which can be used with the blind of FIG. 1.

FIG. 2 shows an alternative cord connector 15A which can guide the looped lift cords 11, 13 of the blind 1 over a curved guiding surface 21.

Figure 3:
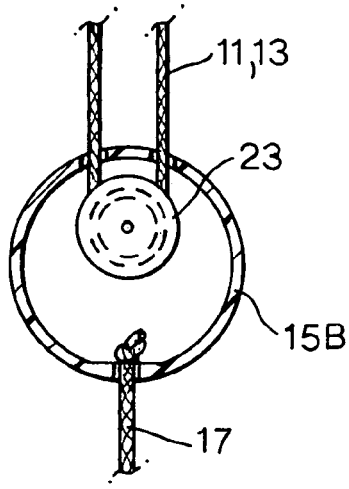

FIG. 3 shows another alternative cord connector 15B which can guide the looped lift cords 11, 13 of the blind 1 over a rotatable guide pulley 23.

FIGS. 4–7 shows a first embodiment of a cord lock 103 of the invention which is similar to the cord lock 3 of FIG. 1 and for which corresponding reference numerals (greater by 100) are used below for describing the same parts or corresponding parts.

Figure 4:
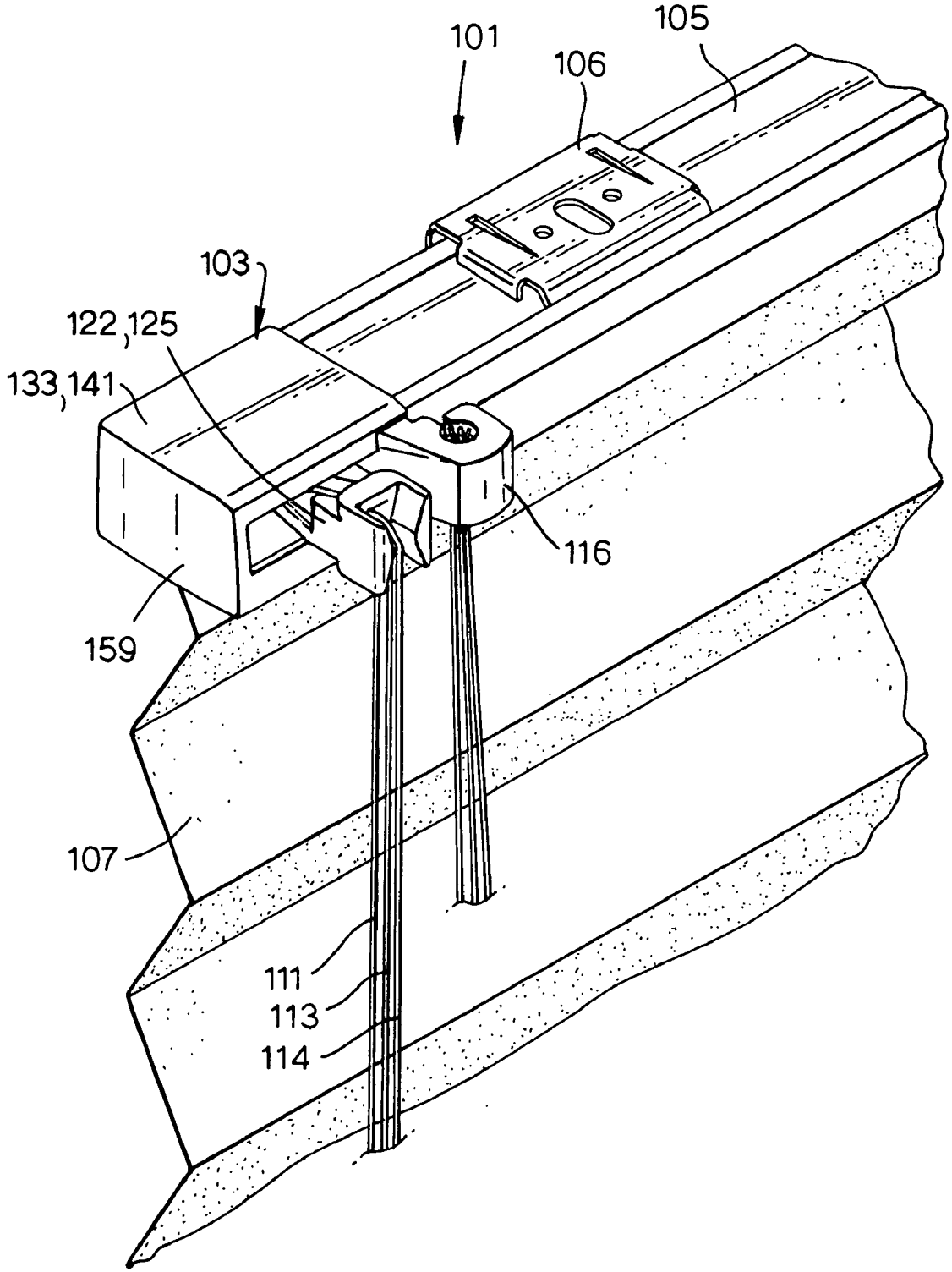
FIG. 4 is a schematic perspective view of a portion of the front of the blind of FIG. 1 with a first embodiment of a cord lock of this invention attached to its head rail.

FIG. 4 shows a pleated blind 101 with its cord lock 103 attached to the left end of its head rail 105. The head rail 105 can be mounted on an overhead structure by means of conventional mounting brackets 106. The head rail 105 also holds an upper edge of a pleated blind fabric 107 which may be retracted by pulling lift cords 111, 113 and 114 together through the cord lock 103. The cord lock 103 has a housing 133, best seen in FIG. 5. A right part of the housing 133 can be inserted in the left end of the head rail 105 as seen from FIGS. 4, 6 and 7.

FIG. 4 also shows the lift cords 111 etc. exiting the cord lock 103 through a cord-guiding funnel 125 on the front of a generally laterally-extending cord-guiding passage 126 in a front portion 122 of a movable, generally laterally-extending locking lever 127 in the housing 133 of the cord lock. The funnel 125 and a front portion of the cord-guiding passage 126 extend outwardly from the front of the housing 133. The lift cords pass downwardly from the funnel 125 and through a connector (not shown) and are then attached to a fixed cord end receptor 116 on the front of a laterally-extending front wall 118 of the cord lock housing 133, located on its front at about its longitudinal middle. The housing's front wall 118 has a left-facing laterally-extending shoulder 120, against which the right side 122A of the front portion 122 of the locking lever 127 can abut to limit its rightward movement during counter-clockwise pivoting of the locking lever as shown in FIG. 6.

Figure 5:
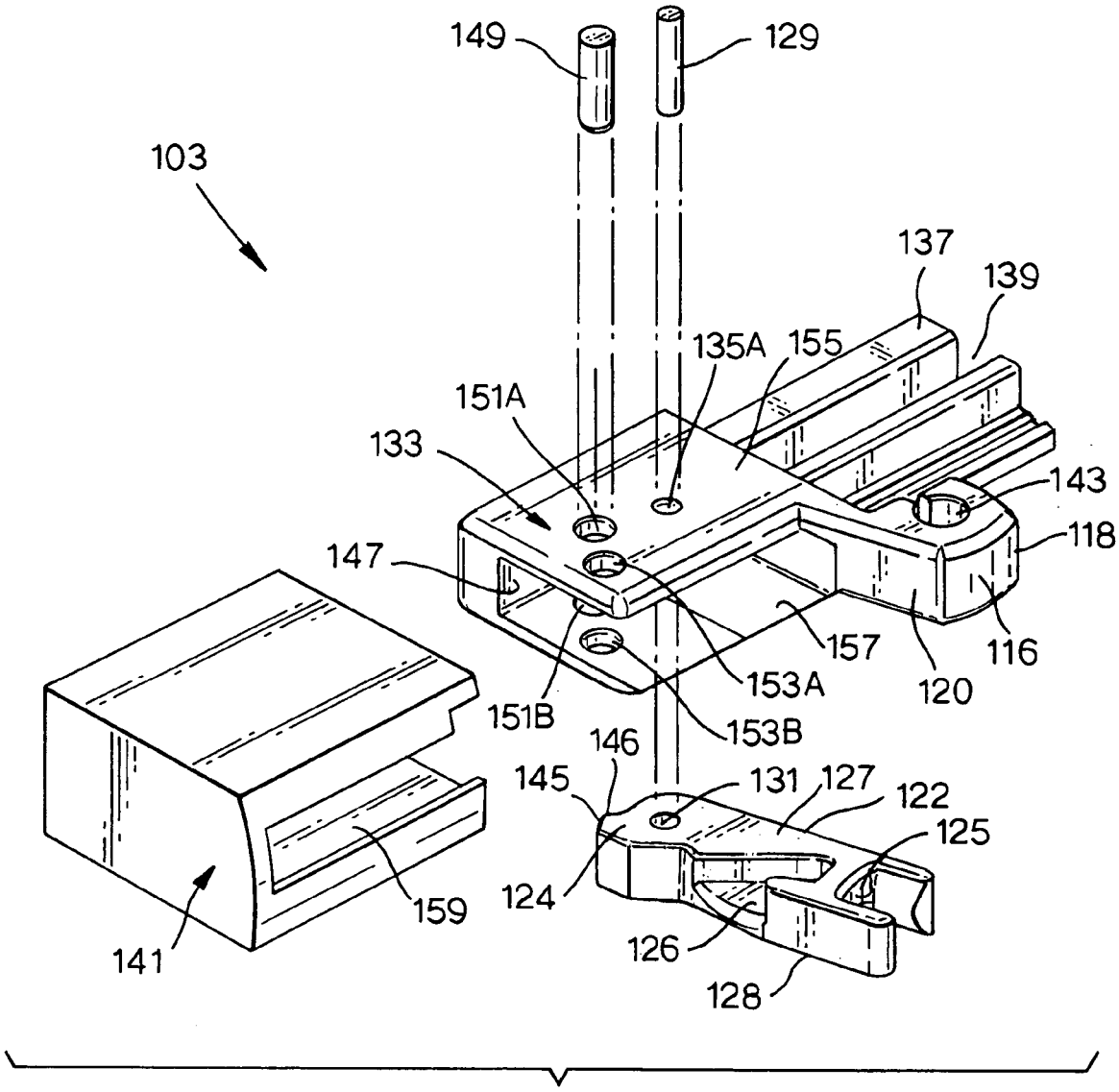
FIG. 5 is an exploded view of the first embodiment of the cord lock of FIG. 4.

FIG. 5 best shows the cord lock's housing 133 and locking lever 127, including its funnel 125 at the front of its cord-guiding passage 126. The right side of the housing 133 has a longitudinally-(rightwardly-)extending profiled tongue 137 which is adapted to be inserted into, and snugly fit within, the contours of the left side of the head rail 105. The profiled tongue 137 has a longitudinally-extending channel 139, through which the lift cords 111 etc. can extend longitudinally from the cord lock housing 133 into the head rail 105. The housing 133 also includes a cover 141, and the cord end receptor 116 of the housing includes a recessed cavity 143 for holding a knot at the end of each lift cord.

Figure 6:
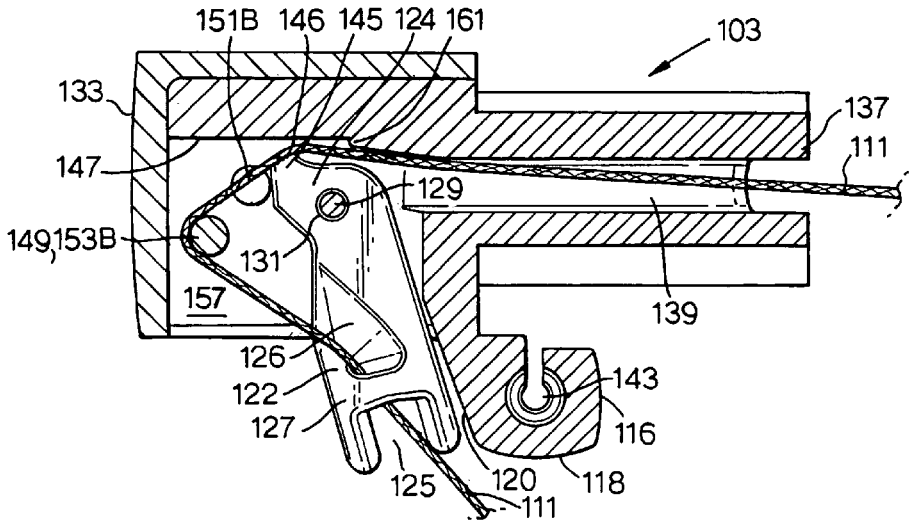
FIGS. 6 and 7 are horizontal-sectional views of the first embodiment of the cord lock of FIG. 4, showing its locking lever pivotally mounted on its bottom wall and its automatic locking operation.
Figure 7:
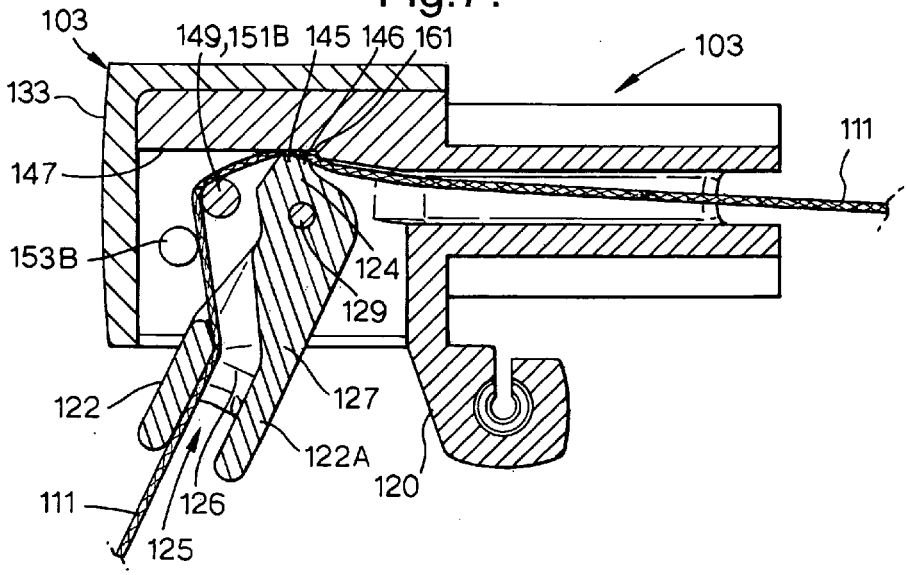

As shown in FIGS. 6 and 7, the locking lever 127 extends horizontally- and rearwardly into the cord lock housing 133 and is pivotally connected to a vertically-extending cylindrical pivot pin 129. The cord-guiding passage 126 in the front portion 122 of the locking lever 127 extends laterally (rearwardly) from the funnel 125 toward the pivot pin 129. A rear portion 124 of the locking lever 127, rearwardly of the pivot pin, has a vertically- and longitudinally-extending rear surface with a cord-gripping formation 145. The cord-gripping formation 145 preferably includes a rearwardly- and rightwardly-facing abutment 146 with a cord-gripping surface As also shown in FIGS. 6 and 7, a vertically- and longitudinally-extending front surface on the rear wall 147 of the cord lock housing 133 includes a locking surface 161. The locking surface 161 is located longitudinally closer to the housing's channel 139 than is the cord-gripping formation 145 in the rear surface of the locking lever 127. The locking surface 161 is preferably also a shoulder on the front surface of the rear wall 147 with a frontally- and leftwardly-facing cord-gripping surface. Thereby, the shoulder of the locking surface 161 can abut against the cord-gripping formation 145 of the locking lever in order to limit its clockwise (rightward) movement as shown in FIG. 7.

As shown in FIG. 4, each pull cord (only 111 is shown) extends upwardly and then rearwardly and horizontally into the cord lock housing 133. Then, as shown in FIGS. 6 and 7, each pull cord extends horizontally within the housing: rearwardly through the funnel 125 and cord-guiding passage 126 of the locking lever 127, rearwardly and to the left about a vertically-extending cylindrical cord-guiding pin 149, rearwardly and to the right between the cord-gripping formation 145 and the rear wall 147 and then rearwardly and to the right towards the channel 139 and the head rail 105.

The cord-gripping formation 145 preferably is adapted to significantly restrain longitudinal movement of the lift cords 111 etc. along its cord-gripping surface, particularly movement to the right, towards the channel 139, when the cord-gripping formation is moved clockwise (to the right) to actually engage the locking surface 161 (as in FIG. 7). However, the cord-gripping formation 145 also is preferably adapted not to significantly restrain longitudinal movement of the lift cords along its cord-gripping surface when it is not actually engaging the locking surface 161 (as in FIG. 6). Likewise, the locking surface 161 preferably is adapted to significantly restrain longitudinal movement of the lift cords 111 etc. along it only when the cord-gripping formation 145 is moved to the right to actually engage it (as in FIG. 7).

A seen from FIG. 5, the pivot pin 129 is received in a first pair of holes 135A, 135B (not shown in FIG. 5), respectively in a horizontally-extending top wall 155 and a horizontally-extending bottom wall 157 of the housing 133. The pivot pin 129 is located longitudinally between the cord-guiding pin 149 and the locking surface 161 on the rear wall 147 of the housing 133 and laterally between the front and rear portions 122, 124 of the locking lever. The locking lever 127 has a vertically-extending bore 131 that is located laterally between its cord-gripping formation 145 and its cord-guiding passage 126 and is pivotally positioned on the pivot pin 129. As a result, as shown in FIG. 7, the locking lever 127 can pivot horizontally about the pivot pin 129, between the top and bottom walls 155, 157 of the housing, so that the rear portion 124 of the locking lever and its cord-gripping formation 145 move rearwardly and horizontally to the right (i.e., clockwise), towards the locking surface 161, when its front portion 122 and its cord-guiding passage 126 are moved horizontally to the left, away from the locking surface 161. Thereby, the cord-gripping formation 145 of the locking lever 127 can tightly hold the pull cords 111 etc. against the locking surface 161 on the rear wall 147 of the housing 137 when the cord-gripping formation is urged rightwardly against the locking surface 161.

The cord-guiding pin 149 in the housing 133 guides each lift cord 111 etc. at an appropriate angle between the cord-gripping formation 145 at the rear of the locking lever 127 and the rear wall 147 of the housing, so that the lift cords frictionally contact, and move longitudinally along, the cord-gripping formation 145 and move longitudinally along the channel 139 whenever the lift cords 111 etc. are being pulled from, or released towards, the cord lock 103 and the head rail 105 by a user of the blind 101. The cord-guiding pin 149 is mounted, in the housing, on the opposite longitudinal side of the locking lever 127 from the channel 139, laterally between the front and rear of the locking lever, and either rearwardly or frontwardly of the pivot pin 129. In this regard, the cord-guiding pin 149 can be mounted in either a second pair of vertically-aligned holes 151A and 151B, rearwardly of the pivot pin 129, or a third pair of vertically-aligned holes 153A and 153B, frontwardly of the pivot pin, in the top and bottom walls 155 and 157, respectively, of the housing. The location of the cord-guiding pin 149 will be selected depending upon which is better, in view of whether the cord lock is to be used with a head rail that is horizontal or is slanted. In this regard, the cord-guiding pin 149 is preferably located (in FIG. 6) in the third pair of holes 153A and 153B, laterally farther from the rear wall 147, for a vertically-slanted head rail 105 and is preferably located (in FIG. 7) in the second pair of holes 151A and 151B, laterally closer to the rear wall 147, for a horizontal head rail 105.

Sliding the cover 141 over the housing 133 of the cord lock 103 secures the pins 129 and 149 in their respective holes 135A, 135B, 151A, 151B, 153A, 153B. A longitudinally-extending slot 159 in the right side of the front of the cap 141 ensures that the funnel 125 of the locking lever 127 and the front wall 118 of the housing 133, with its cord end receptor 116, can properly extend outwardly of the cap 141.

In the unlocked position of the cord lock 103 as shown in FIG. 6, the locking lever 127 has been pivoted in a counter-clockwise direction, so that its rear is moved longitudinally (to the left) away from the channel 139, by a user of the blind 101 pulling on the lift cords 111 etc. Thereby, the cord-gripping formation 145 on the rear portion 124 of the locking lever has been moved longitudinally away from the locking surface 161 on the rear wall 147 of the housing 133 and preferably also frontwardly away from the locking surface 161. This has disengaged the cord-gripping formation 145 from the locking surface 161. Thereby, the lift cords can move relatively freely longitudinally between the rear portion 124 of the locking lever and the rear wall 147 of the housing. However, the weight of the covering 107 on the lift cords 111 etc. causes the lift cords to continuously engage frictionally the rear portion 124 of the locking lever and its cord-gripping formation 145 and to continuously urge the rear portion of the locking lever to pivot back in a clockwise direction, longitudinally to the right toward the channel 139, from its counter-clockwise position in FIG. 6, caused by the user's pull on the lift cords. Nevertheless while the user continues to pull on the lift cords, the rear of the locking lever remains pivoted to the left, in a counter-clockwise position, and the cord lock remains unlocked.

In the locked position of the cord lock 103 as shown in FIG. 7, the locking lever 127 has been pivoted automatically in a clockwise direction. This automatic pivoting is a result of the weight of covering 107 on the lift cords 111 etc. which produces a continuous frictional engagement of the lift cords with the rear portion 124 of the locking lever and its cord-gripping formation 145 and which urges the rear portion of the locking lever to move longitudinally (to the right) once the user's pull on the front portion 122 of the locking lever (to keep the cord lock unlocked) has been released. In the locked position of the cord lock, the cord-gripping formation 145 on the rear portion 124 of the locking lever 127 is urged against, and engages, the cord-gripping surface of the locking surface 161 of the rear wall 147 of the housing 133. Thereby, the cord-gripping formation 145 and the locking surface 161 grip tightly the lift cords 111, etc. between them and prevent the lift cords from moving longitudinally between them.

In operation, the cord lock 103 automatically moves from its unlocked position in FIG. 6 to its locked position in FIG. 7. This occurs when the user of the blind 101 releases the lift cords 111 etc., which allows the weight of the pleated blind fabric 107 to pull the lift cords upwardly to the funnel 125 on the front of the locking lever, then rearwardly through its cord-guiding passage 126, then around the cord-guiding pin 149 and then longitudinally (to the right) between the rear wall 147 of the housing 133 and the rear of the locking lever 127, about and along its cord-gripping formation 145, toward the channel 139 as shown in FIG. 6. The frictional contact between the lift cords and the cord-gripping formation 145, as the fabric 107 pulls the lift cords to the right about and along the rear of the locking lever 127, causes the locking lever to pivot clockwise about the pivot pin 129, until its cord-gripping formation is urged against, and engages, the locking surface 161 on the rear wall 147 of the housing 133 as shown in FIG. 7.

When the user of the blind 101 again pulls on the lift cords 111 etc., the lift cords are initially pulled longitudinally (to the left), about and along the cord-gripping formation 145 on the rear of the locking lever 127, away from the channel 139. The frictional contact between the lift cords and the cord-gripping formation 145, as the lift cords are pulled to the left, towards the cord-guiding pin 149, causes the locking lever 127 to pivot counter-clockwise about the pivot pin 129 until the cord-gripping formation no longer engages the locking surface 161 of the rear wall 147 of the housing 133 as shown in FIG. 6. The user can then easily pull further on the lift cords to pull up the pleated blind fabric 107 and pull the lift cords longitudinally to the left within the channel 139 and then about and along the cord-gripping formation 145, then around the cord-guiding pin 149, then through the cord-guiding passage 126, and then downwardly from the funnel 125 as shown in FIG. 6.

FIGS. 8–14 show a second embodiment of a cord lock 203 of the invention which is similar to the cord lock 103 of FIGS. 4–7 and for which corresponding reference numerals (greater by 100) are used below for describing the same parts or corresponding parts.

Figure 8:
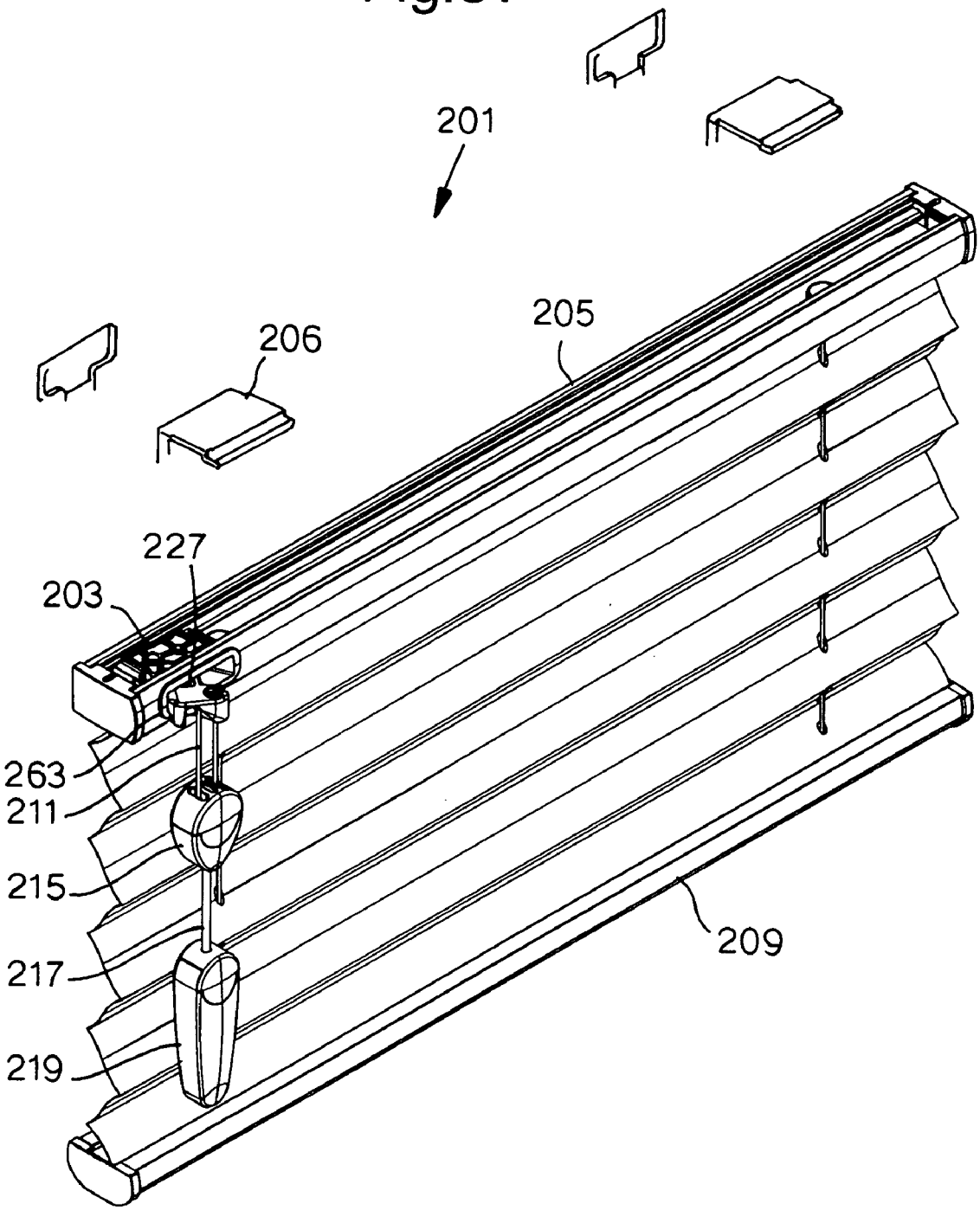
FIG. 8 is a schematic perspective view of the front of a pleated blind with a second embodiment of a cord lock of this invention provided within its head rail.
Figure 9:
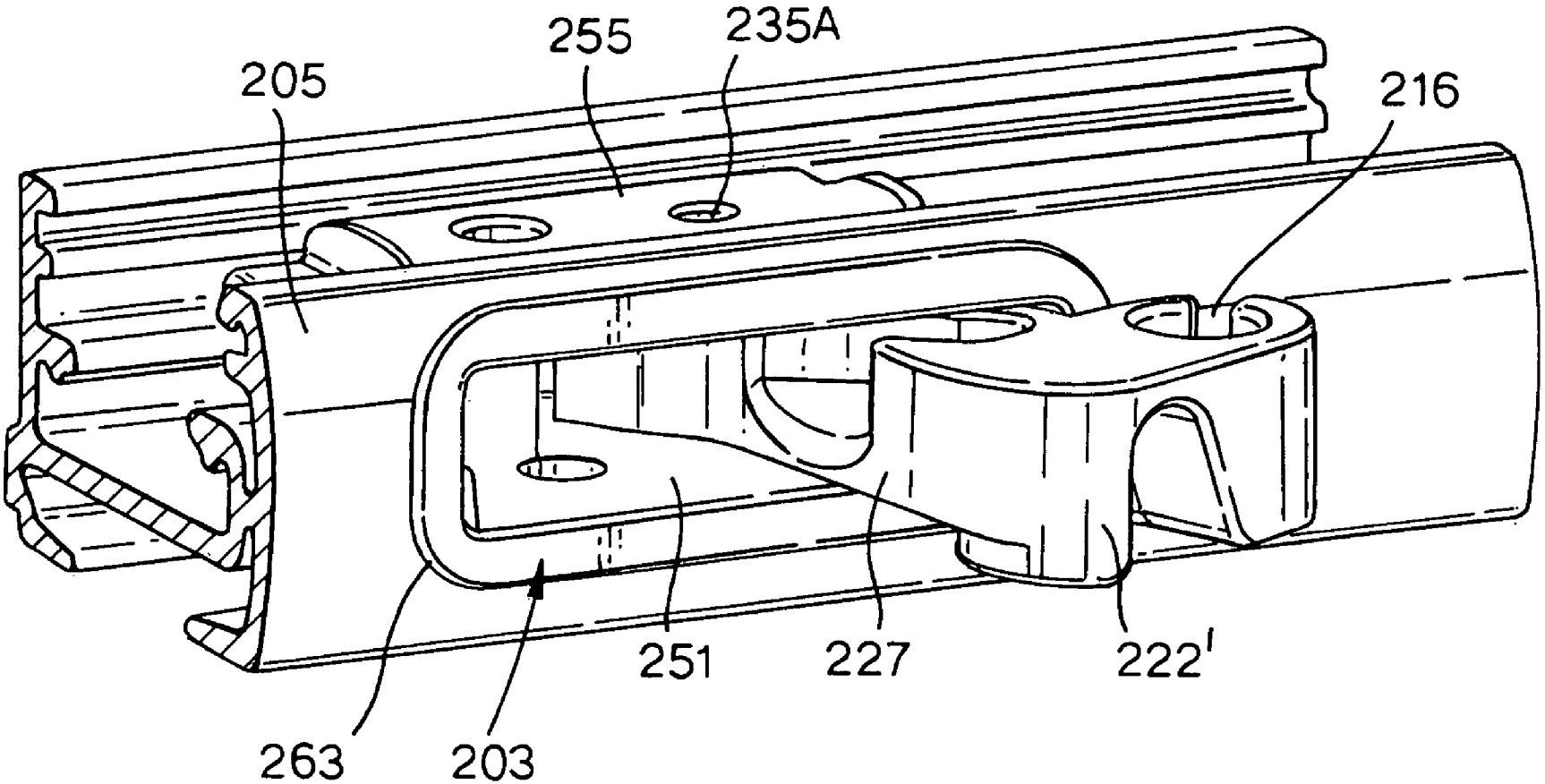
FIG. 9 is a schematic perspective view of the front of the head rail of the blind of FIG. 8 with the second embodiment of a cord lock of this invention within the head rail.
Figure 10:
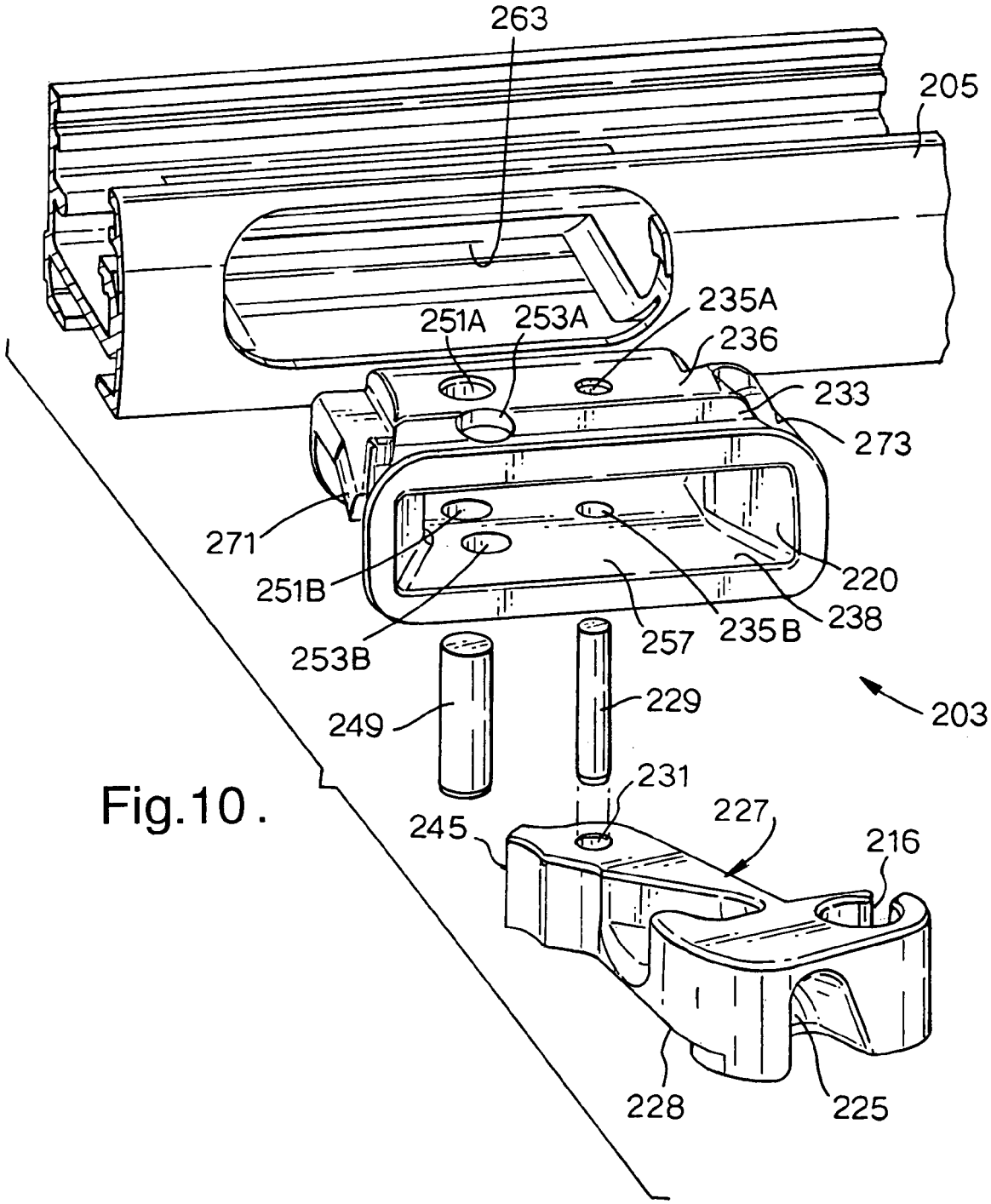
FIG. 10 is an exploded view of the second embodiment of the cord lock.

As seen from FIG. 8, the cord lock 203 for one or more lift cords 211 etc. is accommodated in an opening 263 in the front of the head rail 205 of a pleated blind 201.

Figure 11:
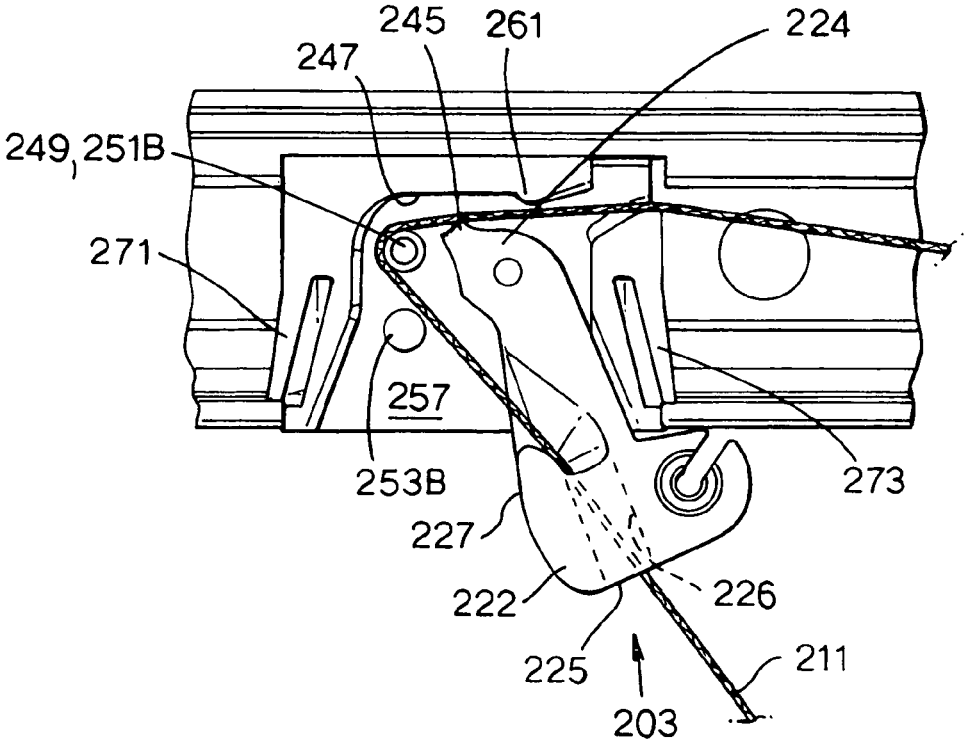
FIGS. 11 to 14 are horizontal-sectional views of the second embodiment of the cord lock, showing its automatic locking operation.
Figure 12:
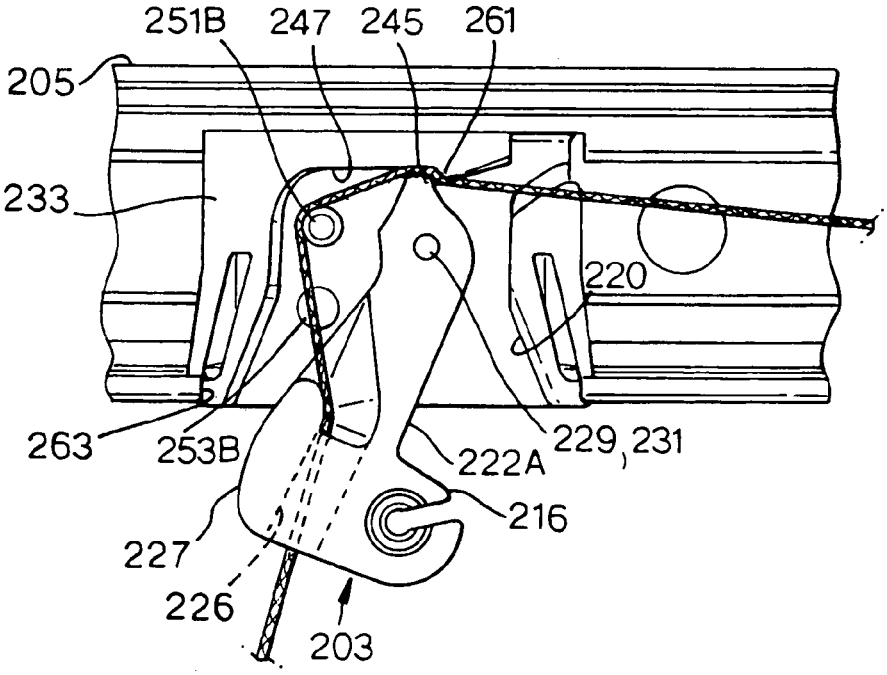

As seen from FIGS. 9–14, the cord lock 203 has a horizontally- and rearwardly-extending locking lever 227. A front portion 222 of the locking lever 227 contains a generally laterally-extending rear surface cord-guiding passage 226, and a rear portion 224 of the locking lever 227 has a vertically- and longitudinally-extending rear surface with a cord-gripping formation 245. The cord lock 203 also has a vertically- and frontally-extending locking surface 261 on the rear wall 247 of the housing 233. Preferably, a cord end receptor 216 is also provided in a front portion 222 of the locking lever 227 when the blind 201 includes a cord connector like those shown in FIG. 2 or 3. The locking lever 227 has a bore 231, pivotally located on a pivot pin 229. The pivot pin 229 is mounted in a first pair of holes 235A and 235B in respectively the top wall 255 and bottom wall 257 of the housing 233. As a result, the locking lever 227 can pivot horizontally about the pivot pin, between the top and bottom walls 255, 257 of the housing 233, so that the rear portion 224 of the locking lever and its cord-gripping formation 245 automatically move rearwardly and horizontally to the right (clockwise), towards the locking surface 261, as shown in FIG. 12, when a user of the blind 201 releases its lift cords 211 etc.

Figure 13:
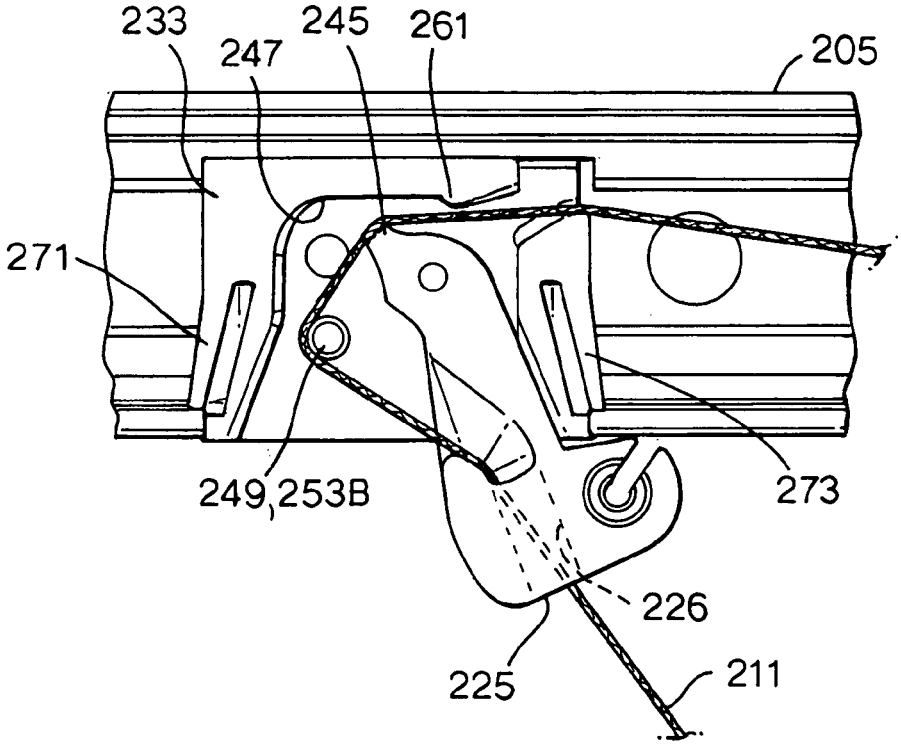
Figure 14:
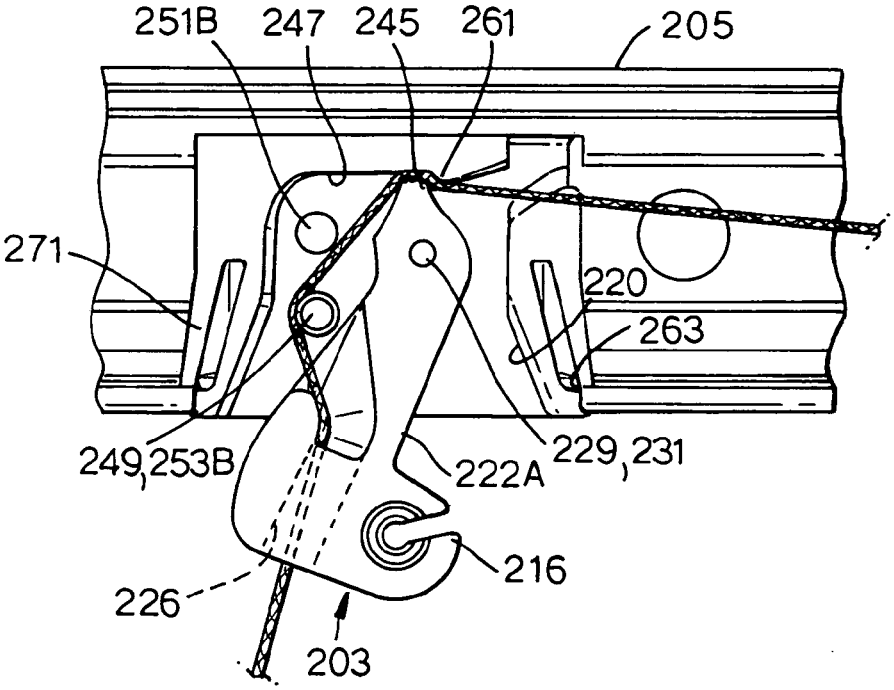

As also seen from FIGS. 9–14, the cord lock 203 also has a vertically-extending cylindrical cord-guiding pin 249. The cord-guiding pin 249 can be mounted at two different horizontal locations in the housing 233, corresponding to either a second pair of vertically-aligned holes 251A and 251B (as shown in FIGS. 11 and 12) or a third pair of vertically-aligned holes 253A and 253B (as shown in FIGS. 13 and 14) in the top and bottom walls 255 and 257, respectively, of the housing. The cord lock housing 233 has an interior left-facing laterally-extending wall with a shoulder 220, against which the right side 222A of the front portion 222 of the locking lever 227 can abut to limit its rightward movement during counter-clockwise pivoting of the locking lever as shown in FIGS. 11 and 13.

As further seen from FIGS. 10–14, the cord lock housing 233 features, on its longitudinally opposite sides, a pair of longitudinally-resilient tongues 271 and 273. The tongues 271 and 273 extend frontwardly and longitudinally away from middle portions of longitudinally opposite sides of the housing 233. The tongues are thereby adapted to frictionally engage internal portions of the head rail 205 on longitudinally opposite sides of the opening 263 in the front of the head rail and on longitudinally opposite sides of the housing, so as to retain the housing in the opening.

Figure 15:
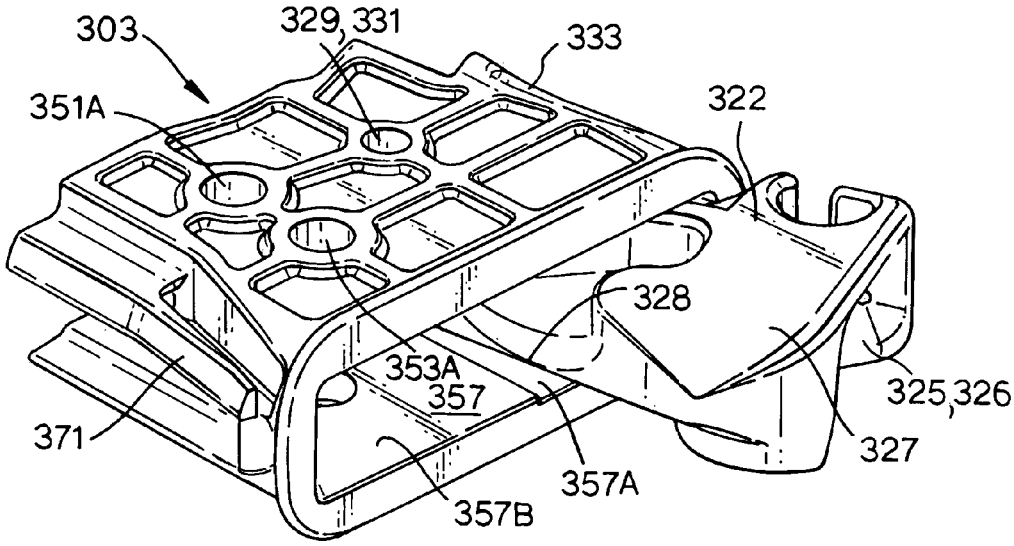
FIGS. 15 and 16 are schematic perspective views of a third embodiment of a cord lock of this invention.
Figure 16:
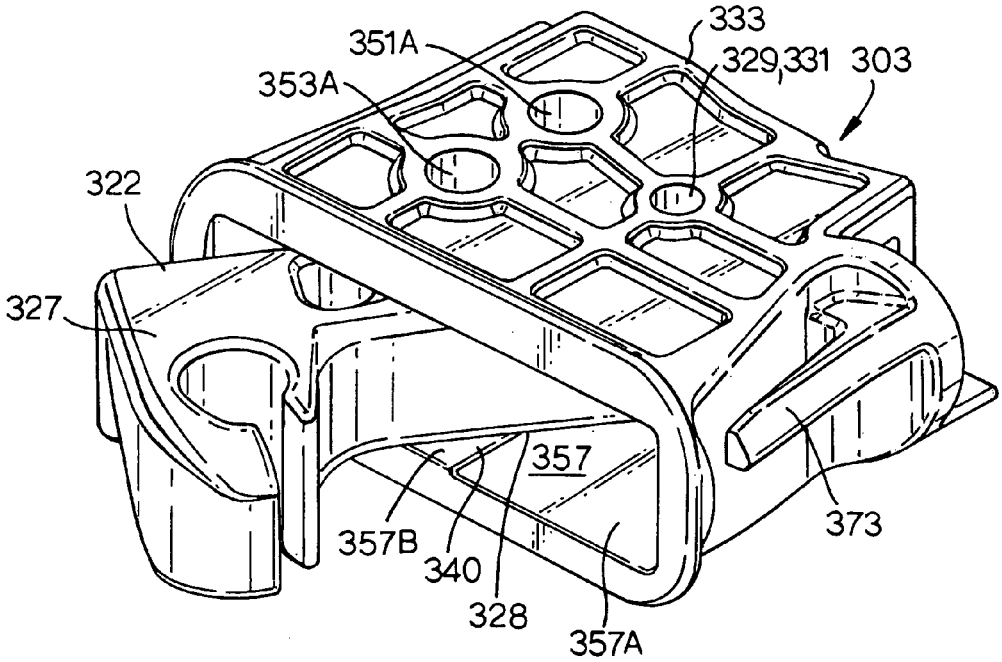

FIGS. 15 and 16 show a third embodiment of a cord lock 303 of the invention which is similar to the cord lock 103 of FIGS. 8–14 and for which corresponding reference numerals (greater by 200) are used below for describing the same parts or corresponding parts.

As seen from FIGS. 15 and 16, the cord lock 303 has a horizontally- and rearwardly-extending locking lever 327. A front portion 322 of the locking lever 327 contains a generally laterally-extending cord-guiding passage 326, and a rear portion (not shown) of the locking lever 327 has a vertically- and rearwardly-extending surface with a cord-gripping formation (not shown). The cord lock 303 also has a vertically- and frontally-extending locking surface (not shown) on the rear wall (not shown) of its housing 333.

As also seen from FIGS. 15 and 16, the cord lock housing 333 features a stepped horizontally-extending lower wall 357. A vertically-extending threshold 340 divides the lower wall 357 into a right lower section 357A, adjacent the locking surface (not shown), and a left upper section 357B, adjacent a cord-guiding pin (not shown) between the locking lever's cord-guiding passage 326 and cord-gripping formation (not shown). In the unlocked position of the cord lock 303, shown in FIG. 15, parts of the front portion 322 of the locking lever 327 rest on the lower section 357A of the lower wall 357. In the locked position of the cord lock 303 shown in FIG. 16, parts of the front portion 322 of the locking lever 327 rest on the upper section 357B of the lower wall 357. As a result, during the clockwise rotation of the locking lever 327 about its pivot pin 329 from its unlocked position to its locked positions, parts of the front portion 322 of the locking lever transfer from the lower section 357A onto the upper section 357B, and the horizontally-extending bottom edge 328 of the locking lever moves over the threshold 340. As long as a user of the blind, provided with the cord lock 303, is pulling downwardly on the lift cords (not shown) to maintain the cord lock unlocked, parts of the front portion 322 of the locking lever 327 are also pulled downwardly, thereby making it difficult for the bottom edge 328 of the front portion 322 of the locking lever 327 to pass over the threshold 340 onto the upper section 357B. However, once the user releases tension on the lift cords to allow the locking lever to move automatically into its locked position, parts of the front portion 322 of the locking lever 327 are no longer being pulled downwardly and the bottom edge 328 of the front portion 322 of the locking lever 327 can pass over the threshold 340 onto the upper section 357B with the automatic clockwise rotation of the locking lever. In this way, a simple indexing of the locking lever is obtained between its unlocked and locked positions. This arrangement is very cost effective as it does not require any additional parts.

Figure 17:
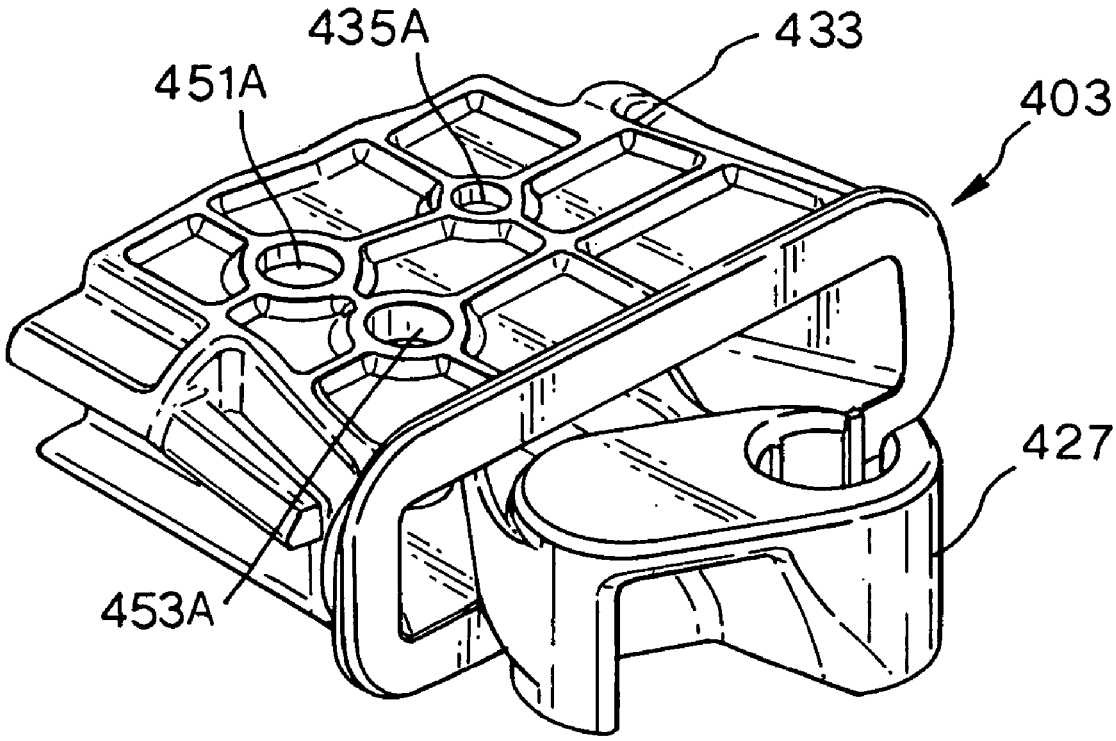
FIG. 17 is a schematic perspective view of the front of a fourth embodiment of a cord lock of this invention.
Figure 18:
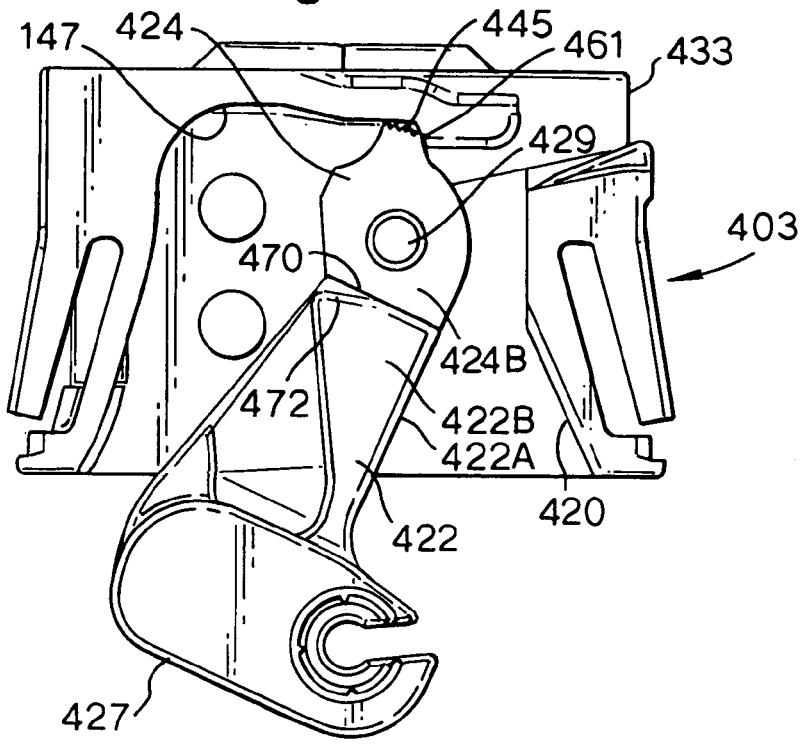
FIGS. 18 and 19 are horizontal-sectional views of the fourth embodiment of the cord lock of FIG. 17, showing its automatic locking operation.
Figure 19:
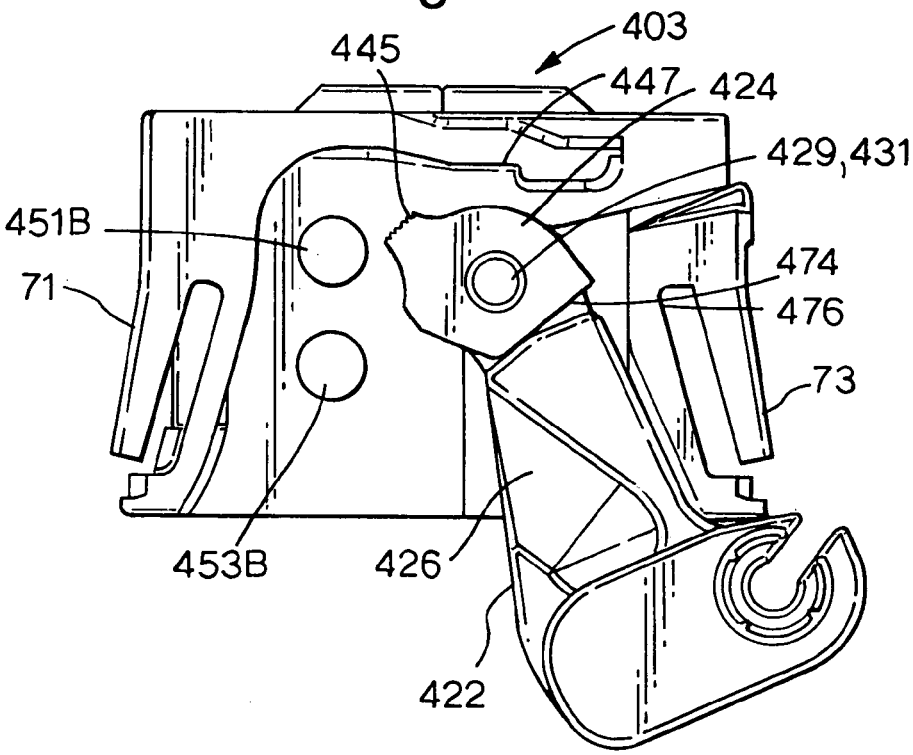

FIGS. 17–19 show a fourth embodiment of a cord lock 403 of the invention which is similar to the cord lock 103 of FIGS. 8–14 and for which corresponding reference numerals (greater by 300) are used below for describing the same parts or corresponding parts.

As seen from FIGS. 17–19, the cord lock 403 has a horizontally- and rearwardly-extending locking lever 427. A front portion 422 of the locking lever 427 contains a generally laterally-extending cord-guiding passage 426, and a separate rear portion 424 of the locking lever 427 has a vertically- and rearwardly-extending surface with a cord-gripping formation 445. A front part 424B of the rear portion 424 and an adjacent rear part 422B of the front portion 422 are pivotally connected to the pivot pin 429. At least the front part 424B of the rear portion 424 lies atop the rear part 422B of the front portion 422. The cord lock 403 also has a vertically- and frontally-extending locking surface 461 on the rear wall 447 of its housing 433.

As seen from FIG. 19, the front and rear portions 422, 424 of the locking lever 427 can swivel counter-clockwise about the pivot pin 429 when a user of a blind with the cord lock 403 pulls lift cords (not shown), extending through the cord lock 403. However, the rear portion 424 can swivel counter-clockwise further, preferably by about 15°, than the front portion 422 with longitudinal movement of the lift cords toward the cord-guiding pin 449. The limit to the counter-clockwise swivel of the rear portion 424, relative to the front portion 422, is established by the abutment of a vertically-extending left front edge 470 of the rear portion 424 with an adjacent vertically-extending left rear edge 472 of the front portion 422. Thereby, the cord-gripping formation 445 on the rear portion 424 of the locking lever can swivel further away from the locking surface 461 on the rear wall 447 of the housing when the user of the blind pulls the lift cords. The housing 433 has a left-facing laterally-extending interior wall with a shoulder 420, against which the right side 422A of the front portion 422 of the locking lever 427 can abut to limit its rightward movement during counter-clockwise pivoting of the locking lever as shown in FIG. 19.

As seen from FIG. 18, the front and rear portions 422, 424 of the locking lever 427 can also swivel clockwise about the pivot pin 429 when the user releases the lift cords (not shown). However, the rear portion 424 can swivel clockwise further than the front portion 422 with longitudinal movement of the lift cords away from the cord-guiding pin 449. The limit to the clockwise swivel of the rear portion 424, relative to the front portion 422, is established by the abutment of a vertically-extending right rear edge 474 of the rear portion with an adjacent vertically-extending right front edge 476 of the front portion. Thereby, the cord-gripping formation 445 on the rear portion 424 of the locking lever can engage the locking surface 461 on the rear wall 447 of the housing to hold the lift cords when the user releases his grip on them.

This invention is, of course, not limited to the above-described embodiments which may be modified without departing from the scope of the invention or sacrificing all of its advantages. In this regard, the terms in the foregoing description and the following claims, such as "longitudinal", "lateral", "left", "right", "vertical", "horizontal", "clockwise", "counter-clockwise", "upwardly" and "downwardly", have been used only as relative terms to describe the relationships of the various elements of the cord lock of the invention for window coverings. For example, the cord locks 3, 103, 203, 303 and 403 could be for slatted venetian blinds or the like, rather than for blinds such as pleated blinds 1 and 101.

We claim:

1. An automatically activated cord lock for a window covering comprising:

a housing having parallel first and second walls and a locking surface extending between the first and second walls;

a locking lever within the housing having a cord-gripping formation on one end adjacent the locking surface and a cord-guiding passage at an opposite end remote from the locking surface; the locking lever being pivotable about only one pivot pin that is located between the cord-gripping formation and the cord-guiding passage and extends between the first and second walls of the housing so that the cord-gripping formation can move toward and away from the locking surface with pivoting movement of the locking lever about the single pivot pin; and a fixed cord guiding surface operatively connected to said housing located spaced apart from and adjacent to a longitudinal side of the locking lever and between the ends of the locking lever.

2. The cord lock of claim 1 wherein the first and second walls and the locking lever extend horizontally, the cord-guiding passage extends laterally, end the pivot pin and the guiding surface extend vertically.

3. The cord lock of claim 2 wherein the pivot pin is located laterally between the guiding surface and the locking surface.

4. The cord lock of claim 3 wherein the pivot pin is located longitudinally between the guiding surface and the locking surface.

5. The cord lock of any one of claims 1–4 wherein the guiding surface also extends between the first and second walls of the housing.

6. The cord lock of any one of claims 1–4 wherein a lower first wall has a lower section on a longitudinal side adjacent the locking surface and an upper section on an apposite longitudinal side adjacent the guiding surface.

7. The cord lock of claim 6 wherein a vertically-extending threshold is between the lower section and the upper section of the lower first wall.

8. An automatically activated cord lock, including:

a housing having a locking surface and parallel first and second walls;

a locking lever having a cord gripping formation on one longitudinal end and a cord guiding passage at an opposite longitudinal end; said lever being pivoted about only one pivot shaft located intermediate the cord gripping formation and the cord guiding passage and being pivotally accommodated in the housing with the pivot shaft extending between the first and second walls of the housing; and a fixed guiding surface operatively connected to said housing.

9. The cord lock of claim 8 further including a pin having said fixed guiding surface, said pin being selectively mountable in one of at least two different predetermined positions on said housing.

10. The cord lock of claim 8 or 9 further including an element having said guiding surface, said element being selectively mountable in at least two different positions on the housing.

11. An automatically activated card lock which includes:

a housing, said housing having parallel first and second walls and a locking surface extending between the first and second walls;

a locking lever within the housing having a cord gripping formation on one end adjacent the locking surface and a cord guiding passage at an opposite end remote from the locking surface, the locking lever being pivoted about a pivot pin that is located between the cord gripping formation and the cord guiding passage and extends between the first and second walls of the housing so that the cord gripping formation can move toward and away from engagement with the locking surface with pivoting movement of the locking lever about the pivot pin, wherein the locking lever includes a lower first wall having a lower section on a longitudinal side adjacent the locking surface and an upper section on an opposite longitudinal side adjacent the guiding surface, a vertically extending threshold between the lower section and the upper section of the lower first wall and wherein the locking lever has a first portion, on which is located the cord guiding passage and a second portion on which is located the cord gripping formation, wherein adjacent first and second parts of the first and second portions are pivotally connected to the pivot pin and further wherein the second portion can swivel further, preferably by about 15°, and the first portion about the pivot pin; and a fixed guiding surface located between the ends of the locking lever.

12. The cord lock of claim 11 wherein at least the second part of the second portion lies atop the first part of the first portion.

13. The cord lock of claim 11 wherein swiveling of the second portion, relative to the first portion, about the pivot pin is limited by abutment of their adjacent confronting edges.

14. The cord lock of claim 11 wherein the first and second walls in the locking lever extend horizontally, the cord guiding passage extends laterally, and the pivot pin and the guiding surface extend vertically.

15. The cord lock of claim 14 wherein the pivot pin is located laterally between the guiding surface and the locking surface.

16. The cord lock of claim 15 wherein the pivot pin is located longitudinally between the guiding surface and the locking surface.

17. An automatically activated cord lock for a window covering, which includes;

a housing, said housing having parallel first and second walls and a locking surface extending between the first and second walls;

a locking lever within the housing having a cord gripping formation on one end adjacent the locking surface and a cord guiding passage at an opposite end remote from the locking surface, the locking lever being pivoted about a pivot pin located between the cord gripping formation and the cord guiding passage and extends between the first and second walls of the housing so the cord gripping formation can move toward and away from engagement with the locking surface with pivoting movement of the locking lever about the pivot pin, the locking lever having a first portion on which is located the cord guiding passage and a second portion on which is located the cord gripping formation, wherein adjacent first and second parts of the first and second portions are pivotally connected to the pivot pin and wherein the second portion can swivel further, preferably by about 15°, than the first portion about the pivot pin with pivoting movement of the locking lever about the pivot pin; and a fixed guiding surface located between the ends of the locking lever.

18. The cord lock of claim 17 wherein the first and second walls in the locking lever extend horizontally, the cord guiding passage extends laterally and the pivot pin and the guiding surface extend vertically.

19. The cord lock of claim 18 wherein the pivot pin is located laterally between the guiding surface and the locking surface.

20. The cord lock of claim 19 wherein the pivot pin is located longitudinally between the guiding surface and the locking surface.

* * * * *